US005676626A

United States Patent [19]

Huang

[11] Patent Number: 5,676,626

[45] Date of Patent: Oct. 14, 1997

[54] ROCKING EXERCISER

[76] Inventor: Andrew Huang, 6F-1, No. 2, Lane 41, Tein Mou W. Rd., Taipei, Taiwan

[21] Appl. No.: 714,281

[22] Filed: Sep. 17, 1996

[51] Int. Cl.[6] ..... A63B 69/06

[52] U.S. Cl. ..... 482/96; 482/95; 482/72

[58] Field of Search ..... 482/95, 96, 72, 482/57, 130, 106, 110

[56] References Cited

U.S. PATENT DOCUMENTS

| | | | |
|---|---|---|---|
| 4,300,760 | 11/1981 | Bobroff | 482/95 |
| 4,743,010 | 5/1988 | Geraci | 482/72 |
| 5,342,269 | 8/1994 | Huang et al. | 482/95 |
| 5,366,428 | 11/1994 | Liao | 482/96 |
| 5,429,568 | 7/1995 | Chen | 482/96 |
| 5,458,553 | 10/1995 | Wu | 482/96 |

OTHER PUBLICATIONS

Aerobic Rider p. 1 Owners Manual Jan. 31, 1996.

*Primary Examiner*—Jerome Donnelly
*Attorney, Agent, or Firm*—Bacon & Thomas

[57] ABSTRACT

A rocking exerciser having a pair of support feet, a rocking rod, a seat pad and a parallel linkage is provided. The rocking rod is provided with a handlebar and a back pad movably disposed thereon. One side of the seat pad is provided with a waist pad. The front portion is provided with a foot rest rod. When the rocking rod is driven forward or backward, a corresponding upward biasing movement to the seat is generated by the pertinent linking rods of the parallel linkage. Accordingly, bowing and stretching movements can be readily performed.

5 Claims, 4 Drawing Sheets

ROCKING EXERCISER

BACKGROUND OF THE INVENTION (A) Field of the Invention

The present invention relates to an exerciser, more particularly, to a rocking exerciser wherein a parallel linkage is incorporated with a rocking rod. When the rocking rod is driven forward and backward, the parallel linkage generates an upward biasing movement, such that the users waist can be bowed and extended.

(B) Description of the Invention

There are many commercially available exercisers. During the rocking of the human body, the pertinent muscles can be worked on. Although there are a plurality of variants of vault-type exercises, none of them has been designed to provide a special exercising function to the waist of the human being. During the exercise, the rocking body is not well supported with a movable supporting pad. Even if there is a supporting pad provided, owing to its poor design, the back and shoulder are not well supported.

SUMMARY OF THE INVENTION

It is the object of this invention to provide a rocking exerciser which comprises support feet, a rocking rod, a seat pad and a parallel linkage in such a manner that when the rocking rod is moved forward and backward, the parallel linkage can be suitably biased to generate different biasing movements. Accordingly, with a single configuration of the rocking exercise, the waist of the human body can be well bowed and extended. The structure is simplified and the utilization is increased.

It is a further object of the invention wherein a stem of said rocking rod is provided with a back pad having a positioning bracket, front rollers and rear rollers. By the provision of said front and rear rollers, said back pad can be readily and slidably disposed onto said rocking rod. Accordingly, when the back of the human body rests on the back pad, the positioning bracket is capable of moving up and down to cooperate with the movement of the human body. In light of this, the back of the human being gets full-time protection and support during exercising. A stopper is provided on said rocking rod to limit the lowest position of said back pad.

DETAILED DESCRIPTION OF PREFERRED EMBODIMENT

Figure 1:
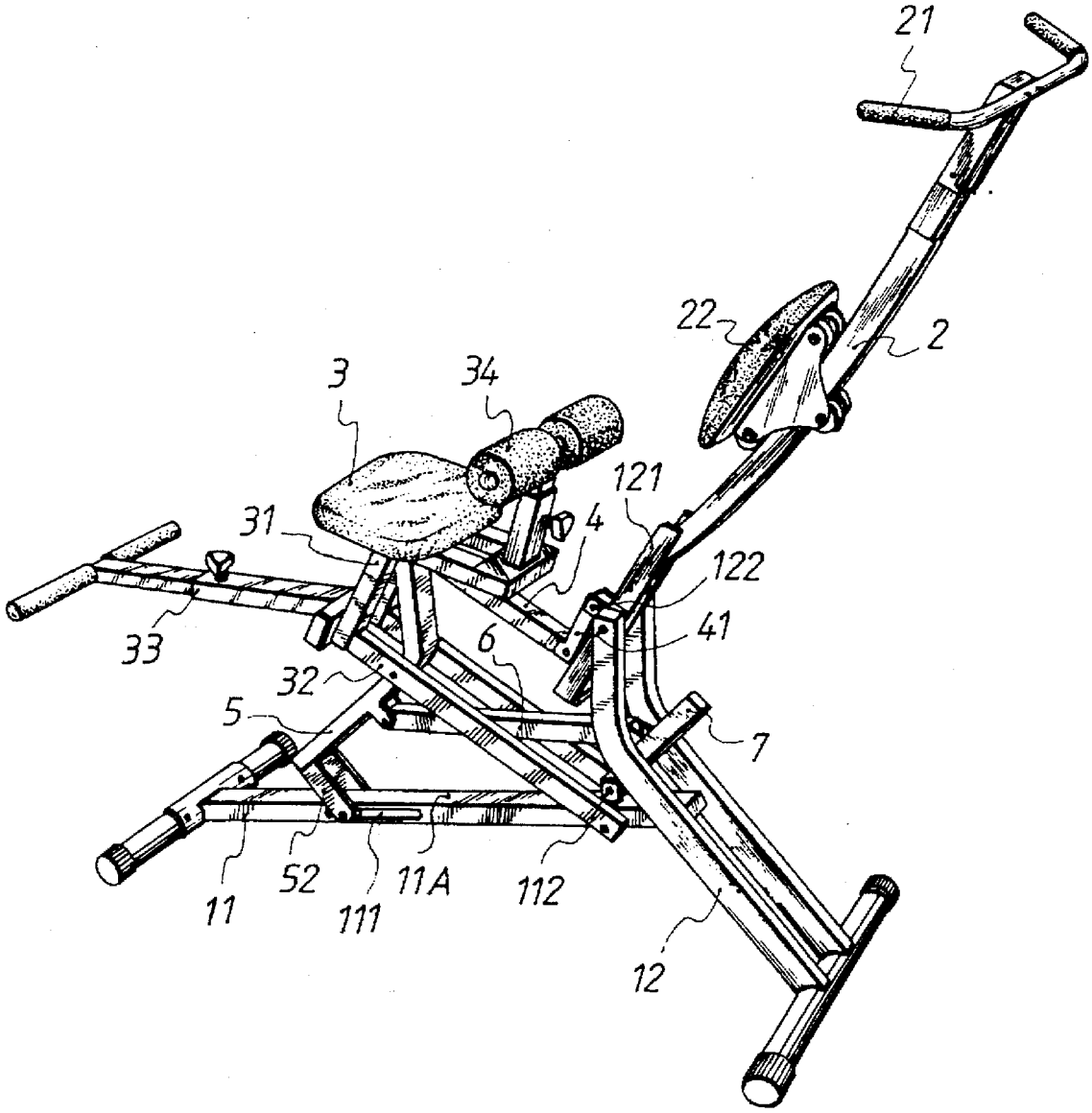
FIG. 1 is a perspective view of a rocking exerciser made according to this invention.
Figure 2:
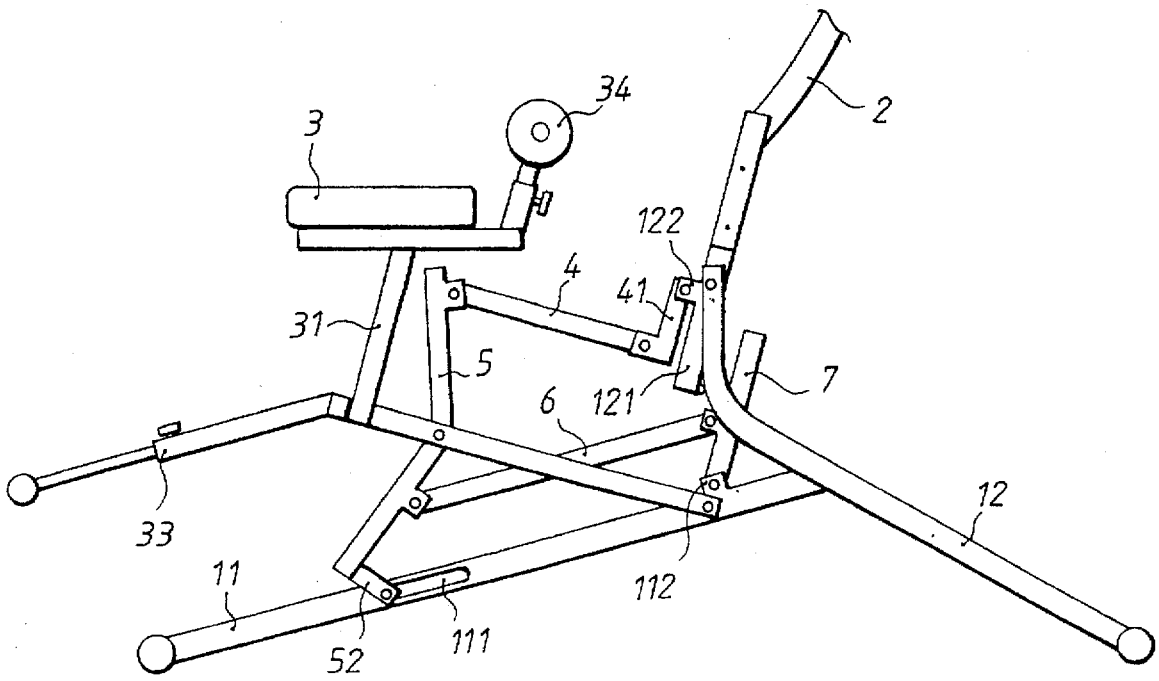
FIG. 2 is a side elevational view of the rocking exerciser made according to this invention.

Referring to FIGS. 1 and 2, the rocking exerciser made according to this invention generally comprises support feet, a rocking rod 2, a seat pad 3 and a parallel linkage which includes four linking rods 4, 5, 6 and 7.

Said support feet includes a from support foot 11 and a rear support foot 12 which are cross-linked and supported with each other. Said front and rear support feet 11, 12 are designed with a T-configuration. A guiding rail slot 111 is provided a the middle portion of said front support foot 11 and a pivoting bracket 112 is provided at a rear portion. The top of said rear support for 12 is provided with a biasing rod 121 pivotally mounted thereon. A pivoting bracket 122 is disposed on said biasing rod 121.

Said rocking rod 2 is a stem member and is locked to said biasing rod 121. A handlebar 21 is disposed atop of said rocking rod. A back rest 22 is slidably disposed thereon.

Said seat pad 3 is disposed on a T-shape supporting bracket 31. The other end of said supporting bracket 31 is permanently mounted to a supporting rod 32. One end of said supporting rod 32 is pivotedly mounted to an end portion of said front support foot 11 and the other end of said supporting rod 32 is permanently mounted to a T-shaped foot rest rod 33.

Said parallel linkage is composed with the first, second, third and fourth linking rods 4, 5, 6 and 7. One end of said first linking rod 4 is pivoted to the pivoting bracket 122 of said biasing rod 121 by means of an auxiliary rod 41. The other end of said first linking rod 4 is pivotedly connected with said second linking rod 5. Said second linking rod 5 is configured with an angle and one end of said second linking rod 5 is provided with a roller 51, as clearly shown in FIG. 3. Said roller 51 can be slidably disposed within said guiding rail slot 111 of said front support foot 11. The middle portion of said second linking rod 5 is provided with pivoting connections for connecting with the end portion of said seat pad supporting rod 32 and third linking rod 6. The end portion of said third linking rod 6 is pivotally connected to the middle portion of said fourth linking rod 7. An end of said fourth linking rod 7 is pivotally connected to the rear portion of said front support foot 11. By this arrangement, said first linking rod 4 and said fourth linking rod 7 are disposed on both sides of said biasing rod 121 respectively.

One side of said T-shaped supporting rod 31 of said seat pad 3 is provided with a waist pad 34 which can be readily relocated in a suitable position to provide a substantial support for the human body. On the other hand, said foot rest rod 33 can be telescopically adjusted to meet different requirements.

With the above provision, the user can sit on said seat pad 3 facing said foot rest rod 33 in such a manner that the left and fight foot are disposed at both sides of said foot rest rod 33. Meanwhile, the waist is well supported by said waist pad 34 and both hands can grip on the handlebar 21 of said rocking rod 2 backward. Then the user can then perform a bowing or a stretching movement through said rocking rod 2.

Figure 4:
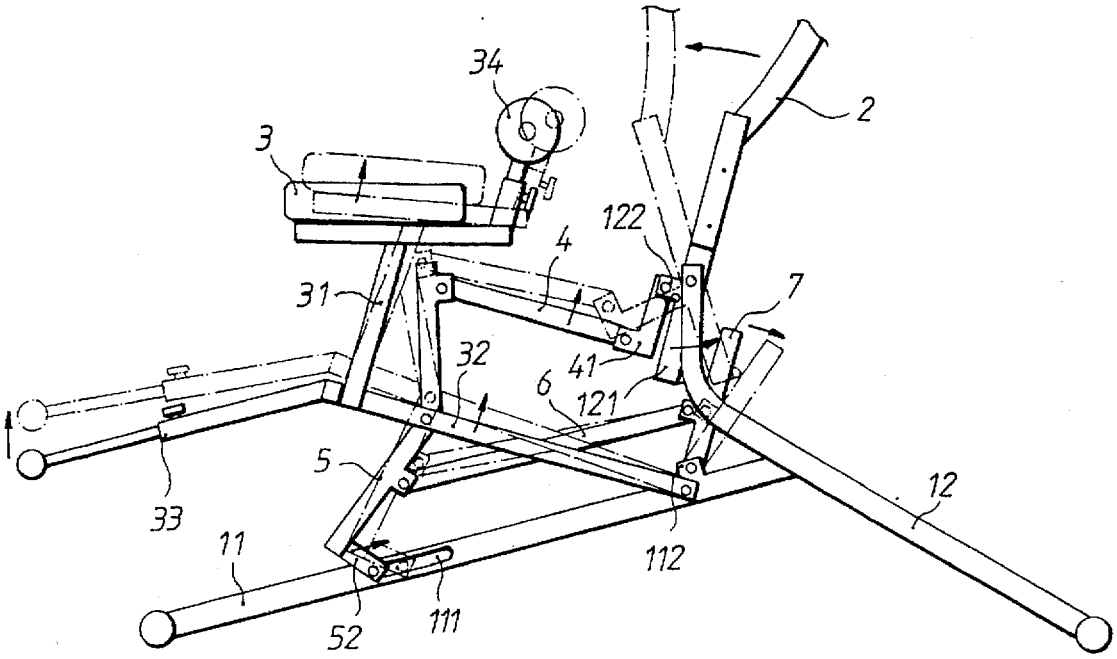
FIG. 4 is a schematic view showing the rocking exerciser during a bowing exercise.

Referring to FIG. 4, when the user is performing a bowing movement, he/she may hold said handlebar 21 of said rocking rod 2 and move his/her upper body forward and downward. Said fourth linking rod 7 is pushed by said biasing rod 121 connected to the end potion of said rocking rod 2. The second linking rod 5 is also pushed back by said fourth linking rod 7 via said third linking rod 6. By this arrangement, said seat pad 3 is moved upward. This bowing movement can be repeated until a certain amount of exercising is achieved.

Figure 5:
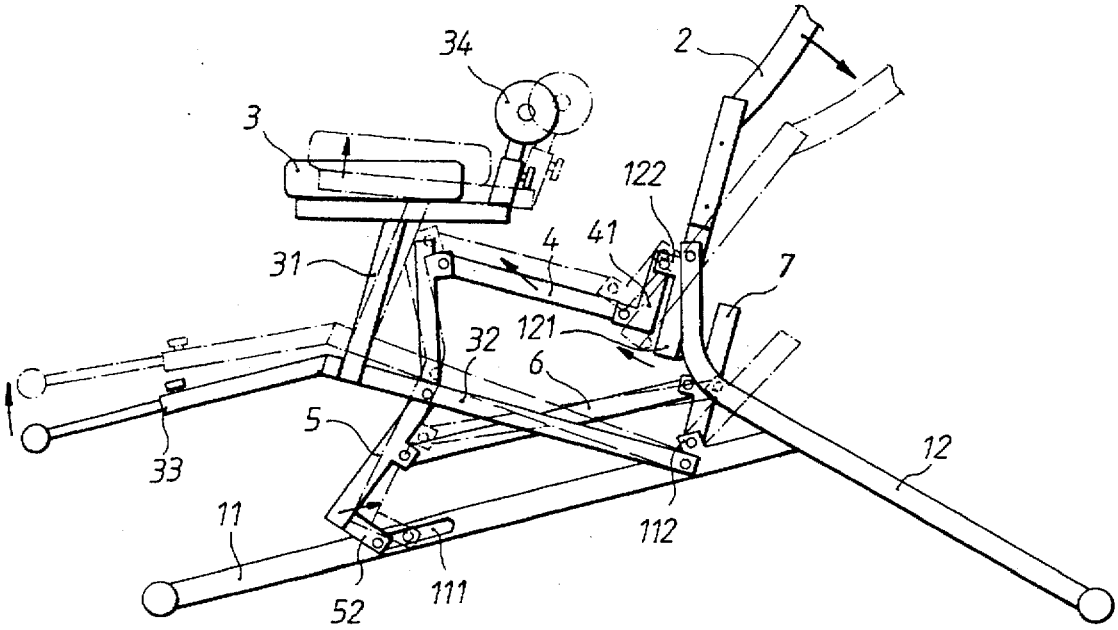
FIG. 5 is a schematic view showing the rocking exerciser is applied for stretching exercise.

Referring to FIG. 5, when the user performs a stretching movement, he/she may take the preparing posture as above described and push said handlebar 21 of said rocking rod 2 backward. Then, said first linking rod 4 is pushed by said biasing rod 121 connected to said rocking rod 2. As a result, said second linking rod 5 moves said seat pad 3 upward. Again, this stretching movement can be repeated until a certain amount of exercising is achieved.

Figure 3:
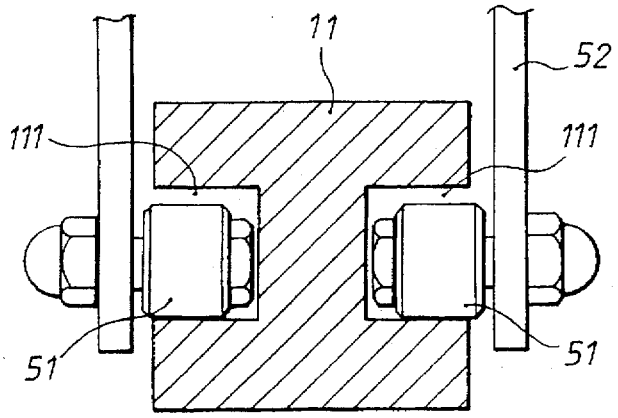
FIG. 3 is a cross-sectional view showing the assembling of the end of the second linking rod and the rail of the from supporting bracket according to this invention.

As described above, a roller 51 is disposed at the end portion of said second linking rod 5 and is freely rotational within said guiding rail slot 111 disposed respectively on both sides of said front support foot 11. The end portion of said second linking rod 5 has a roller bracket 52. A roller 51 is disposed within said roller bracket 52 and is rotationally received within said guiding rail slot 111, as shown in FIG. 3. Alternatively, said roller 51 can be disposed on front surface 11A of said front support foot 11 such that said second linking rod 5 can freely move along said front surface 11A. Other variants can be readily appreciated to those skilled in the art.

Figure 6:
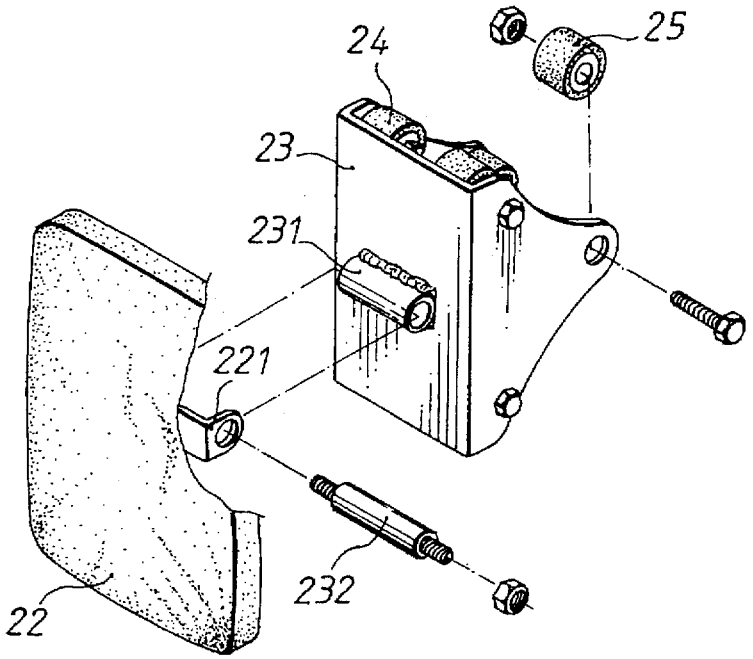
FIG. 6 is an exploded perspective view showing the back pad according to this invention.

Furthermore, said back pad 22 is slidably disposed on said stem member of said rocking rod 2. The main configuration of said back pad 22 comprises a positioning bracket 23, a front roller 24 and a rear roller 25, clearly shown in FIGS. 6 and 7.

Said back pad 22 is provided with a connecting plate 221 to be attached to said positioning bracket 23.

Said positioning bracket 23 is a supporting bracket having a U-shaped cross section. A sleeve 231 is disposed atop of said bracket 23. A shaft 232 is used to attach said connecting plate 221 of said back pad 22 to said sleeve 231 by passing therethrough. On the front and rear portions of the inner side of said bracket are disposed front roller 24 and rear roller 25. By this arrangement, said stem member of said rocking rod 2 is sandwiched by said front roller 24 and rear roller 25. Accordingly, said back seat pad 22 is moveable along said rocking rod 2 to provide a substantial support to the back portion of the user.

Figure 7:
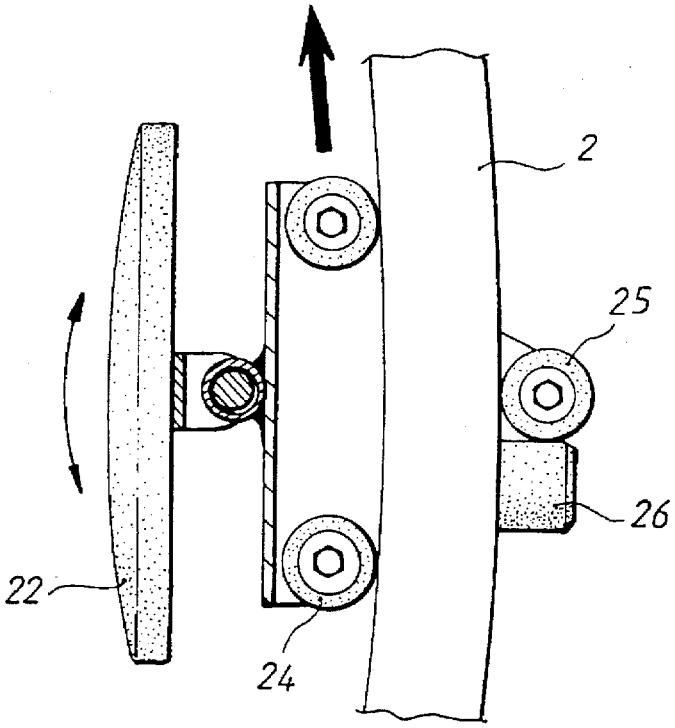
FIG. 7 is a cross sectional view showing the assembling of the rocking rod and the back pad.

On the other hand, a stopper 26, as shown in FIG. 7, is disposed at suitable position on said rocking rod 2 to establish a lower limit for said back pad 22.

While particular embodiments of the present invention have been illustrated and described, it will be obvious to those skilled in the art that various other changes and modifications can be made without departing from the spirit and scope of the invention. It is therefore intended to cover in the appended claims all such changes and modifications that are within the scope of the present invention.

I claim:

1. A rocking exerciser comprising support feet, a rocking rod, a seat pad, a back pad and a parallel linkage assembly which includes four linking rods, wherein:

said support feet comprise a front support foot and a rear support foot attached to each other, a top of said rear support foot having a biasing rod pivotally mounted thereon, said biasing rod having a pivoting bracket thereon;

said rocking rod comprising a T-shaped supporting bracket mounted to a supporting rod, one end of said supporting rod being pivotally mounted to an end portion of said front support foot another end of said supporting rod having a T-shaped foot rest rod;

said parallel linkage comprising first, second, third and fourth linking rods, wherein one end of said first linking rod is pivoted to the pivoting bracket of said biasing rod, another end of said first linking rod pivotally connected with said second linking rod, said second linking rod configured with a sharp angle and one end of said second linking rod being provided with a roller in contact with a portion of the front support foot, a middle portion of said second linking rod being pivotally connected with end portions of said seat pad supporting rod and said third linking rod, another end portion of said third linking rod pivotally connected to a middle portion of said fourth linking rod, an end of said fourth linking rod being pivotally connected to a rear portion of said front support foot, whereby said first linking rod and said fourth linking rod are disposed on opposite sides of said biasing rod respectively;

such that, when said rocking rod is moved in a first direction said fourth linking rod is pushed by said biasing rod connected to the end portion of said rocking rod, the second linking rod is also pushed back by said fourth linking rod via said third linking rod whereby said seat pad is moved upward; and when said rocking rod is moved in a second direction said first linking rod is pushed by said biasing rod connected to said rocking rod, causing said second linking rod to move said seat pad upward.

2. The rocking exerciser as recited in claim 1, further comprising a waist pad on said T-shape supporting bracket.

3. The rocking exerciser as recited in claim 1, further comprising a guiding rail slot formed in at least one side of said front support foot such that said roller on said second linking rod is rotationally received within said guiding rail slot.

4. The rocking exerciser as recited in claim 1, wherein said back pad is slidably mounted on said rocking rod and comprises a positioning bracket, a front roller and a rear roller, wherein:

said back pad is provided with a connecting plate, said positioning bracket has a supporting bracket having a U-shaped cross section, a sleeve is mounted on said positioning bracket, a shaft attaching said connecting plate of said back pad to said sleeve by passing through said sleeve and said connecting plate, said positioning bracket having front and rear rollers, whereby said rocking rod is sandwiched between said front and rear rollers, such that said back seat pad is moveable along to said rocking rod to provide a substantial support to the back portion of the user.

5. The rocking exerciser as recited in claim 4 further comprising a stopper disposed on said rocking rod to define a lower limit for movement of said back pad.

* * * * *